US007714833B2

(12) United States Patent
Kamio

(10) Patent No.: US 7,714,833 B2
(45) Date of Patent: May 11, 2010

(54) DISPLAY APPARATUS AND DRIVE CONTROL METHOD THEREOF

(75) Inventor: Tomomi Kamio, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 1273 days.

(21) Appl. No.: 11/220,862

(22) Filed: Sep. 7, 2005

(65) Prior Publication Data

US 2006/0050011 A1 Mar. 9, 2006

(30) Foreign Application Priority Data

Sep. 9, 2004 (JP) ..... 2004-262525

(51) Int. Cl.
*G09G 5/00* (2006.01)

(52) U.S. Cl. ..... 345/103; 345/100; 345/204

(58) Field of Classification Search ..... 345/1.1–1.3, 345/87–103, 30, 211, 204; 349/142, 150–152
See application file for complete search history.

(56) References Cited

U.S. PATENT DOCUMENTS

| | | | | |
|---|---|---|---|---|
| 6,297,786 | B1 * | 10/2001 | Kakuta et al. | 345/1.1 |
| 7,016,703 | B2 | 3/2006 | Kishimoto et al. | |
| 2002/0015015 | A1 * | 2/2002 | Leung et al. | 345/87 |
| 2003/0210215 | A1 | 11/2003 | Takahashi | |
| 2004/0021616 | A1 * | 2/2004 | Goto et al. | 345/1.1 |
| 2004/0169618 | A1 * | 9/2004 | Nakai et al. | 345/1.1 |
| 2004/0222943 | A1 * | 11/2004 | Kudo et al. | 345/1.1 |
| 2007/0291041 | A1 * | 12/2007 | Nakai et al. | 345/530 |

FOREIGN PATENT DOCUMENTS

| | | | |
|---|---|---|---|
| JP | 2002-204297 | A | 7/2002 |
| JP | 2003-323164 | A | 11/2003 |
| JP | 2004-163790 | A | 6/2004 |
| JP | 2004-240236 | A | 8/2004 |

OTHER PUBLICATIONS

Japanese Office Action dated Feb. 9, 2010 and English translation thereof issued in counterpart Japanese Application No. 2004-262525.

* cited by examiner

*Primary Examiner*—Amare Mengistu
*Assistant Examiner*—Koosha Sharifi
(74) *Attorney, Agent, or Firm*—Frishauf, Holtz, Goodman & Chick, P.C.

(57) ABSTRACT

A display apparatus which displays an image corresponding to a display signal comprising a plurality of display panels which have, respectively, a plurality of display pixels; and•• a control means which sets at least one display panel among the plurality of display panels in a display state and sets the plurality of display panels other than the at least one display panel in a non-display state, drives the display panel which has been set in the display state based on the display signal for each of a plurality of constant frame periods, and drives the display panel which has been set in the display state based on the display signal and performs a refresh operation of the display panel which has been set in the non-display state only in a specific frame period from the plurality of constant frame periods.

15 Claims, 11 Drawing Sheets

DISPLAY APPARATUS AND DRIVE CONTROL METHOD THEREOF

CROSS-REFERENCE TO RELATED APPLICATION

This application is based upon and claims the benefit of priority from the prior Japanese Patent Application No. 2004-262525, filed Sep. 9, 2004, the entire contents of which is incorporated herein by reference.

BACKGROUND OF THE INVENTION

1. Field of the Invention

The present invention relates to a display apparatus having a plurality of display panels and accompanying drive control method.

2. Description of the Related Art

As the display panel in portable electronic apparatus, such as cellular phones, Personal Digital Assistant (PDAs), etc., a lot of display apparatuses have a liquid crystal display (hereinafter, denoted as "LCD") panel with thin shape, light weight and low power consumption. In particular, many display apparatuses have a LCD panel of the active-matrix method which uses thin film transistors (TFTs) as the display panel.

On the LCD panel of such display apparatuses, a plurality of scanning lines and a plurality of signal lines are arranged to mutually intersect and display pixels are formed near each intersection point.

FIG. 9 is an equivalent circuit view showing an example configuration of a display pixel.

As seen in FIG. 9, each display pixel composes a thin film transistor (TFT) 91 connected to a scanning line G and a signal line S, a pixel electrode 92 connected to the signal line S via the TFT 91, a common electrode 93 arranged in a location which faces toward the pixel electrode 92, a pixel capacitance 94 with liquid crystal filled between the pixel electrode 92 and the common electrode 93, and an auxiliary capacitance 31 connected in parallel to the pixel capacitance 94 which holds the applied voltage of the pixel capacitance 94. An image display is actualized according to the arrangement of the liquid crystal molecules which change by an electric field formed between the pixel electrode 92 and the common electrode 93.

In particular, the TFT 91 gate electrode is connected to the scanning line G, the source electrode is connected to the signal line S, and the drain electrode is connected to the pixel electrode 92 of the pixel capacitance 94 and one electrode of the auxiliary capacitance 31. Also, a predetermined common voltage VCOM (common electrode signal) is applied to the common electrode 93. The other electrode of the auxiliary capacitance 31 is connected to a common lines C (auxiliary capacitance lines)•• and the predetermined common voltage VCOM (common electrode signal) is applied. When high electric potential is applied to the TFT 91 gate terminal via the scanning line G, the TFT 91 switches to an "ON" state. An electric field is formed between the pixel electrode 92 and the common electrode 93 by the electric potential of the signal line S being applied to the pixel electrode 92 and drives the liquid crystal filled between such electrodes.

Furthermore, in order to visually capture a display image in an LCD, backlight is provided, for example, by an LED in the rear surface of the LCD panel. The permeated amount of light emitted from the backlight is controlled by the arrangement of the liquid crystal molecules. The luminosity of each display pixel is adjusted and the desired image is displayed.

Moreover, in recent years, an electronic apparatus equipped with a display apparatus having a plurality of LCD panels is known as represented by a foldable type cellular phone provided with a main screen and a sub-screen. In a display apparatus having such a plurality of LCD panels, in order to simplify the structure, the signal lines for each LCD panel are connected together. For example, when having two LCD panels constituting the main screen and the sub-screen, the wiring of the signal lines allocated in the main LCD panel is extended to the sub-LCD panel, which is used to drive both LCD panels with one source driver. Also, the scanning lines are wired separately for each LCD panel. The common voltage VCOM applied to the common electrode of each LCD panel is generated and applied to each LCD panel.

FIG. 10 is a diagram showing a signal waveform example of a conventional prior art case with the signal lines connected together and performing display drive of the two LCD panels for the main screen and the sub-screen with common signal lines.

In FIG. 10, the number of scanning lines of the main LCD panel is denoted as "m1" and the number of scanning lines of the sub-LCD panel is denoted as "m2." As shown in this diagram, the time axis is set on the horizontal axis. The sequence listed from the top shows the polarity of the display signal applied to the signal lines S, the common voltage $V_{COM1}$ applied to the common electrode of the main LCD panel, the common voltage $V_{COM2}$ applied to the common electrode of the sub-LCD panel and a signal waveform of each scanning line G of the two LCD panels.

As seen in this diagram, in the case of having two LCD panels, a 1 frame period constitutes a back portion (BP), a main screen display period which makes the main LCD panel the displaying object, a middle portion (MP), a sub-screen display period which makes the sub-LCD panel the displaying object and a front portion (FP). BP is the period from ending output of a horizontal synchronization signal until beginning output of the display signal for the main LCD panel. MP is the period from ending output of the display signal for the main LCD panel until beginning output of the display signal for the sub-LCD panel. FP is the period from ending output of the display signal for the sub-LCD panel until beginning output of the horizontal synchronization signal and is a non-display period known as a retrace line period. Here, "1 frame period" indicates a period which displays one image on each LCD panel.

In the main screen display period, as the scanning lines $G_1$~$G_{m1}$ of the main LCD panel are sequentially scanned and set in a selective state, the display signal of the image to be displayed on that LCD panel is applied to the signal lines S. Also, in the sub-screen display period, as the scanning lines $G_{m1+1}$~$G_{m1+m2}$ of the sub-LCD panel are set in a selective state, the display signal of the image to be displayed on that LCD panel is applied to the signal lines S. Namely, in 1 frame period, the desired image is displayed on each LCD panel by sequentially making the two LCD panels the displaying object.

Generally, in an LCD, reversal drive is performed which reverses the polarity of the electric field in predetermined cycles between the pixel electrode and common electrode filled with liquid crystal. In an LCD as mentioned above, the arrangement of the liquid crystal molecules is determined corresponding to the electric field between electrodes. However, when direct current is applied between these electrodes, it can induce overheating and seizing which causes the liquid crystal to deteriorate and ultimately component failure will occur. Accordingly, this is prevented by cyclically reversing the polarity of the electric field between electrodes.

As reversal drive methods, line reversal drive and frame reversal drive are commonly implemented. Line reversal drive is a method which reverses each frame period while reversing the polarity of each display pixel in every scanning line. Moreover, frame reversal drive is a method which reverses the polarity for each display pixel in every frame period.

More specifically, the signal waveform shown in FIG. 10 can be assumed as line reversal drive and frame reversal drive as the polarity of the display signal and the common voltage $V_{COM1}$, $V_{COM2}$ are reversed in every scanning line and reversed in every frame period. The common voltage $V_{COM1}$, $V_{COM2}$ to the two LCD panels is controlled to always become the same polarity (corresponding polarity) and the display signal is controlled so that the common voltage $V_{COM1}$, $V_{COM2}$ and the polarity become reversed.

Apart from that, in a foldable type of cellular phone provided with two LCD panels for the above-mentioned main screen and sub-screen, generally the sub-LCD panel is placed on the back surface side of the main LCD panel. Also, many of these apparatus are kept in a folded position so as that the main LCD panel is on the inner side. When in a folded position in order to reduce power consumption, the main LCD panel is set in the non-display state. Meanwhile, viewing by the user is accomplished in the sub-LCD panel located on the outer side of the cellular phone as the sub-LCD panel is set in the display state. Conversely, when such a foldable type cellular phone is in an opened position, viewing by the user is accomplished in the main LCD panel as the main LCD panel is set in the display state and the sub-LCD panel is set in the non-display state.

Thus, in an LCD equipped with two LCD panels constituting the main screen and the sub-screen, for example, when the main LCD panel is set in the non-display state, this LCD panel is normally white and in this case ordinarily set in a white display state. Each scanning line of the main LCD panel is set in the non-display state which is a non-scan state. As for the sub-LCD panel, each scanning line is sequentially scanned and the screen display is performed corresponding to the display signal applied to the signal lines. However, even if the scanning lines of the main LCD panel are set in the non-scan state where the TFT is switched "OFF," leakage current occurs between the TFT source and drain. Further, since the signal lines are mutually arranged in the two LCD panels, the electric potential of the signal lines changes with the display signal to the sub-LCD panel. For this reason, even if the main LCD panel is set in the non-display state wherein the scanning lines are in the non-scan state, the electric field applied to the liquid crystal changes due to this leakage current and the non-display state is not satisfactorily sustainable.

Therefore, while setting the main LCD panel in the non-display state (for example, white display state) as the display signal of a white display is applied to each signal line of this LCD panel at predetermined timing, an operation is periodically performed which maintains the entire surface of this LCD panel in a white display state by scanning each scanning line. This operation is called a "refresh operation" and required to be performed at the rate of one time in a plurality of frames.

FIG. 11 is a diagram showing a signal waveform example of a conventional prior art in the case of two LCD panels with common signal lines, the main LCD panel in the non-display state and the sub-LCD panel in the display state, and a refresh operation of the main LCD panel performed at the rate of one time every three frames.

As shown in FIG. 11, the time axis is set on the horizontal axis. The sequence listed from the top shows a signal waveform of the gate numbers to which the scanning signal is applied, the polarity of the display signal applied to the signal lines S, the common voltage $V_{COM1}$ applied to the common electrode of the main LCD panel and the common voltage $V_{COM2}$ applied to the common electrode of the sub-LCD panel.

For example, at the 3n+1 frame in which a refresh operation of the main LCD panel 11 is performed in the main screen display period (main screen refresh operation period), the scanning lines $G_1$~$G_{m1}$ of the main LCD panel are sequentially scanned and the display signal for setting this LCD panel as a full screen white display is applied to the signal lines S. Also, in the sub-screen display period, the scanning lines $G_{m1+1}$~$G_{m1+m2}$ of the sub-LCD panel are sequentially scanned and the display signal of the image to be displayed on this LCD panel is applied to the signal lines S.

Next, the 3n+2 frame and 3(n+1) frame, in the main screen display period, the scanning lines of the main LCD panel set in the non-scan state and the display signal is not applied to the signal lines S. Also, in the sub-screen display period, the scanning lines $G_{m1+1}$~$G_{m1+m2}$ of the sub-LCD panel are sequentially scanned and the display signal of the image to be displayed is applied to the signal lines S.

Subsequently, the 3(n+1)+1 frame, in the main screen display period a refresh operation is performed again and an operation for displaying an image on the sub-LCD panel in the sub-screen display period is performed. In this manner, for example, by performing a refresh operation of an LCD panel set in non-display at the rate of one time every three frames, the non-display state of this LCD panel is sustained.

Apart from that, in FIG. 11, although reversal drive of the polarity for the common voltage $V_{COM2}$ of the sub-LCD panel is performed in every line, reversal drive of the polarity for the common voltage $V_{COM1}$ of the main LCD panel is performed every three frames. In this case, in a frame (for example, 3n+2 frame, etc.) in which a refresh operation of the main LCD panel is not performed, the period corresponding to the main screen display period exists unchanged. In this period, reversal drive of the polarity for each line of the common voltage $V_{COM2}$ of the sub-LCD panel is continued without interruption. Because of this, when the main LCD panel is set in a non-scan state, power consumption related to the reversal drive for the common voltage $V_{COM2}$ of the sub-LCD panel becomes a waste. Accordingly, in a display apparatus having two LCD panels, even if it is the case where one of the LCD panels has been set in the non-display state, wasteful power consumption occurs related to the drive of the LCD panel side set in the non-display state.

SUMMARY OF THE INVENTION

The present invention comprises a plurality of display panels which perform an image display corresponding to a display signal. The present invention has the advantage in that when any one of the display panels is set in the non-display state, wasteful power consumption can be eliminated which results in a favorable reduction in power consumption.

A display apparatus of the present invention for acquiring the above-mentioned advantage comprises at least a plurality of display panels which have, respectively, a plurality of display pixels; and a control means which sets at least one display panel among the plurality of display panels in a display state and sets the plurality of display panels other than the at least one display panel in a non-display state, drives the display panel which has been set in the display state based on the display signal for each of a plurality of constant frame periods, and drives the display panel which has been set in the display state based on the display signal and performs a refresh operation of the display panel which has been set in the non-display state only in a specific frame period from the plurality of constant frame periods. This display apparatus, for example, has two display panels and the control means sets one of the two display panels in the display state and sets the other of the two display panels in the non-display state.

Each of the display panels have a plurality of scanning lines and a plurality of signal lines, the plurality of display pixels have a pixel electrode arranged in matrix form near each intersection point of the plurality of scanning lines and the plurality of signal lines and a common electrode arranged in an opposed position to each of the pixel electrodes. The display apparatus comprises a scan driver which applies a scanning signal sequentially to each of the plurality of scanning lines of each of the display panels; a signal driver which applies a display signal voltage corresponding to the display signal to the plurality of signal lines of each of the display panels; and a common electrode driver which applies a common electrode signal that reverses polarity in a predetermined cycle to the common electrode of each of the display panels. At least a portion of the plurality of signal lines are mutually wired together between each of the display panels. The signal driver applies the display signal voltage to the plurality of signal lines of the display panel which has been set in the non-display state to change the display panel to a white display state during a period which performs the refresh operation in the specific frame period in order to perform the refresh operation. The control means controls each applied timing of the scanning signal applied to each of the scanning lines of the display panel which has been set in the display state by the scan driver; the common electrode signal applied to the common electrode of the display panel which has been set in the display state by the common electrode driver and performs polarity reversals during each of the plurality of constant frame periods.

The control means applies the scanning signal simultaneously to all the scanning lines of the display panel which has been set in the non-display state by the scan driver during a period in the specific frame period which performs the refresh operation in order to perform the refresh operation, or applies the scanning signal simultaneously to each of a predetermined number of scanning lines which are divided into plural segments of the plurality of scanning lines of the display panel which has been set in the non-display state.

The control means controls the common electrode driver to perform polarity reversals of the common electrode signal to the display panel which has been set in the non-display state in each specific frame period which performs the refresh operation, lengthens a cycle of polarity reversals of the common electrode signal to the display panel which has been set in the display state in a plurality of frame periods that do not perform the refresh operation of the display panel which has been set in the non-display state more than a cycle of polarity reversals of the common electrode signal to the display panel which has been set in the display state in the specific frame period which performs the refresh operation, or controls to set the cycle of polarity reversals of the common electrode signal to the display panel which has been set in the display state as the same value in the plurality of frame periods that do not perform the refresh operation of the display panel which has been set in the non-display state.

An electronic apparatus of the present invention for acquiring the above-mentioned advantage has a display apparatus which displays an image corresponding to a display signal,•• comprising at least two display panels which have a plurality of display pixels; and a control means which sets one display panel of the two display panels in a display state and sets the other of the two display panels in a non-display state, drives the display panel which has been set in the display state based on the display signal for each of a plurality of constant frame periods, and drives the display panel which has been set in the display state based on the display signal and a refresh operation of the display panel which has been set in the non-display state only in a specific frame period from the plurality of constant frame periods. This electronic apparatus, for example, is a cellular phone which uses one of the two display panels as a main screen and the other of the two display panels as a sub-screen.

Each of the display panels is a liquid crystal display panel having a plurality of scanning lines and a plurality of signal lines, the plurality of display pixels have a pixel electrode arranged in matrix form near each intersection point of the plurality of scanning lines and the plurality of signal lines, and a common electrode arranged in an opposed position to each of the pixel electrodes. The display apparatus further comprises a scan driver which applies a scanning signal sequentially to each of the plurality of scanning lines of each of the display panels; a signal driver which applies a display signal voltage corresponding to the display signal to the plurality of signal lines of each of the display panels; and a common electrode driver which applies a common electrode signal that reverses polarity in a predetermined cycle to the common electrode of each of the display panels. At least a portion of the plurality of signal lines are mutually wired together between each of the display panels. The signal driver applies the display signal voltage to the plurality of signal lines of the display panel which has been set in the non-display state to change the display panel to a white display state during a period which performs the refresh operation in the specific frame period in order to perform the refresh operation. The control means controls each applied timing of the scanning signal applied to each of the scanning lines of the display panel which has been set in the display state by the scan driver; the common electrode signal applied to the common electrode of the display panel which has been set in the display state by the common electrode driver and performs polarity reversals during each of the plurality of constant frame periods.

The control means applies the scanning signal simultaneously to all the scanning lines of the display panel which has been set in the non-display state by the scan driver during a period in the specific frame period which performs the refresh operation in order to perform the refresh operation, or applies the scanning signal simultaneously to each of a predetermined number of scanning lines which are divided into plural segments of the plurality of scanning lines of the display panel which has been set in the non-display state.

The control means controls the common electrode driver to perform polarity reversals of the common electrode signal to the display panel which has been set in the non-display state in each of the specific frame period which performs the refresh operation, lengthens a cycle of polarity reversals of the common electrode signal to the display panel which has been set in the display state in a plurality of constant frame periods that do not perform the refresh operation of the display panel which has been set in the non-display state more than a cycle of polarity reversals of the common electrode signal to the display panel which has been set in the display state in the specific frame period which performs the refresh operation, or controls the cycle of polarity reversals of the common electrode signal to the display which has been set in the display state as the same value in the plurality of constant frame periods that do not perform the refresh operation of the display panel which has been set in the non-display state.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Figure 1:
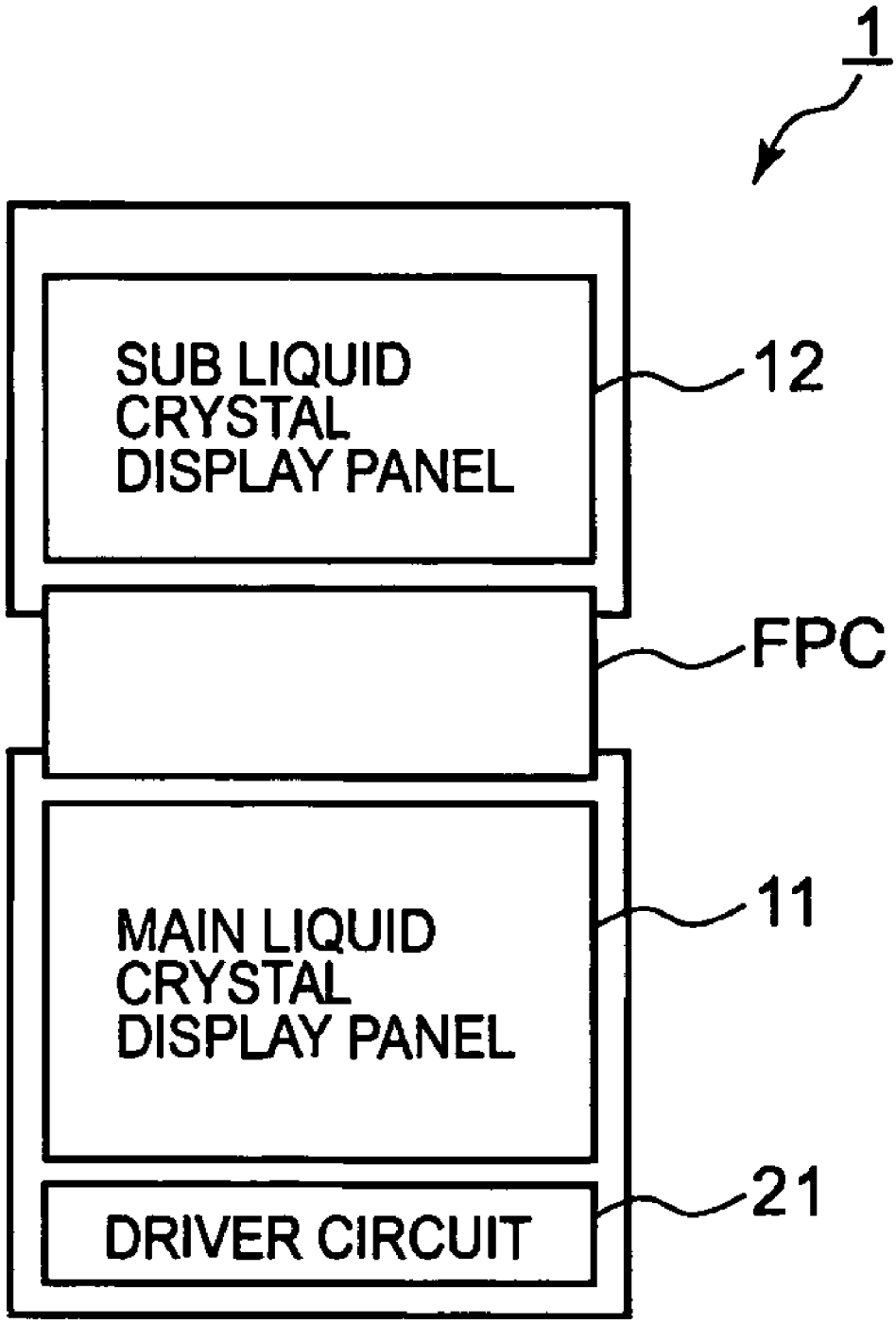
FIG. 1 is an outline configuration diagram showing an example of the display apparatus related to the present invention.

Hereinafter, the details of the display apparatus and associated drive method related to the present invention will be explained based on the preferred embodiments shown in the drawings.

Also, hereinafter a display apparatus having two LCD panels with common signal lines (source lines) will be explained. Moreover, although the case explained below is configured so that one driver circuit which includes a source driver circuit, a gate driver circuit, etc. can be shared with two LCD panels, the display apparatus is not limited to this. For example, it is also effective to have a configuration in which one source driver circuit is shared with two LCD panels and a gate driver circuit is provided for exclusive us in each the LCD panels.

Additionally, in the following, although the two LCD panels have the same number of signal lines, the present invention is not restricted to this. For example, it is also possible to have the number of signal lines of one LCD panel be more than the number of signal lines of the second LCD panel, as well as a portion of the signal lines of one LCD panel may not be wired together with the second LCD panel.

Furthermore, although the display apparatus of the preferred embodiments has two LCD panels, the display apparatus may not only have this number of LCD panels. It is possible to have a plurality of more than three LCD panels.

[Display Apparatus Configuration]

Initially, the display apparatus configuration in the preferred embodiments will be explained.

FIG. 1 is an outline configuration diagram showing an example of the display apparatus related to the present invention.

As seen in FIG. 1, a display apparatus 1 (hereinafter, denoted as "LCD 1") of the preferred embodiments has two display screens and with a main LCD panel 11 as the first screen and a sub-LCD panel 12 as the second screen. The main LCD panel 11 and the sub-LCD panel 12 are electrically connected, for example, via a flexible printed circuit board (FPC). Also, in the main LCD panel 11, a driver circuit 21 (control section) is provided which includes a source driver circuit, a gate driver circuit and a VCOM generation circuit. The driver circuit 21 drives both of these LCD panels 11, 12.

Figure 2:
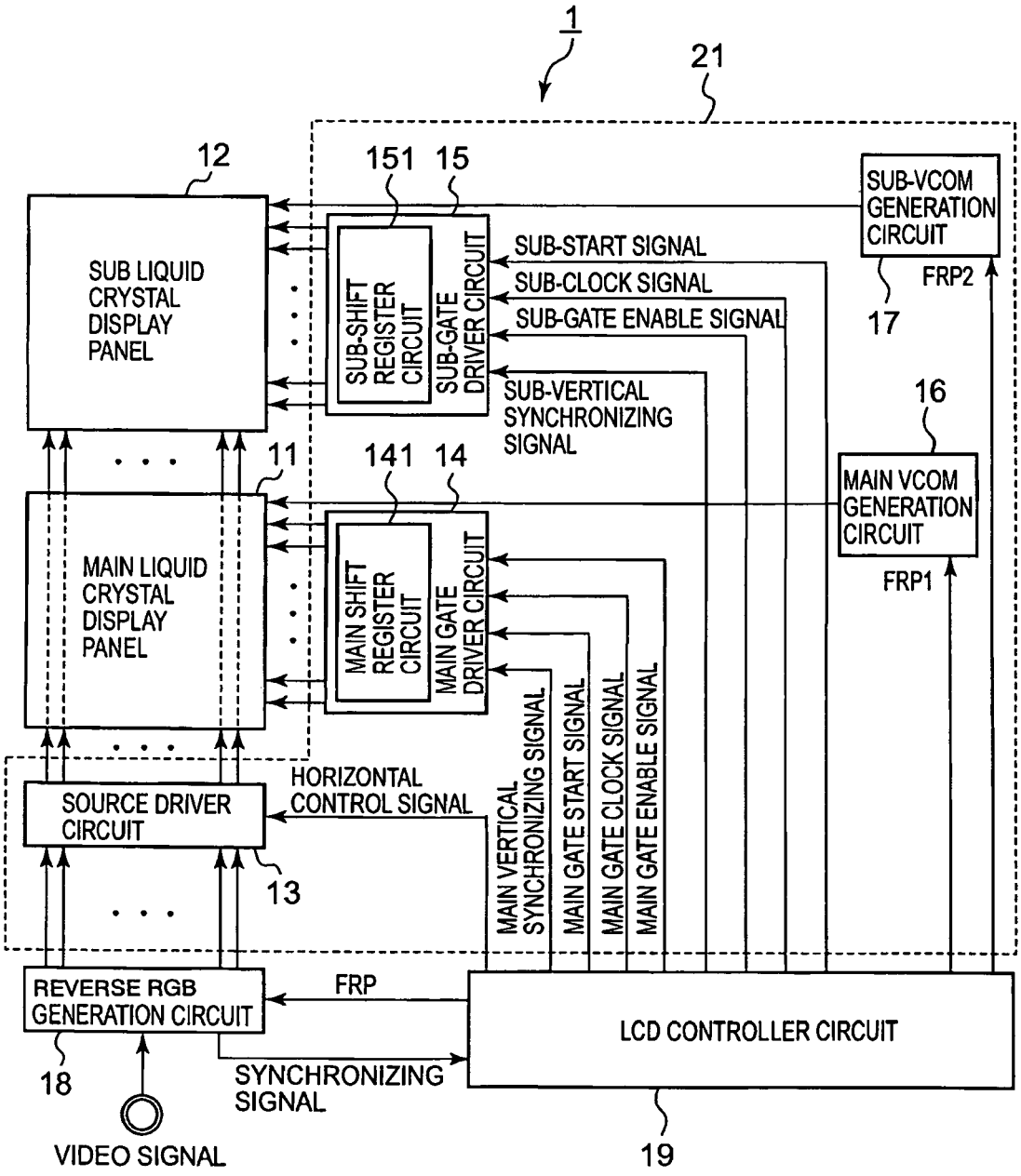
FIG. 2 is a block diagram showing the entire configuration of the display apparatus related to the present invention.

FIG. 2 is a block diagram showing the entire configuration of the display apparatus related to the present invention.

Figure 3:
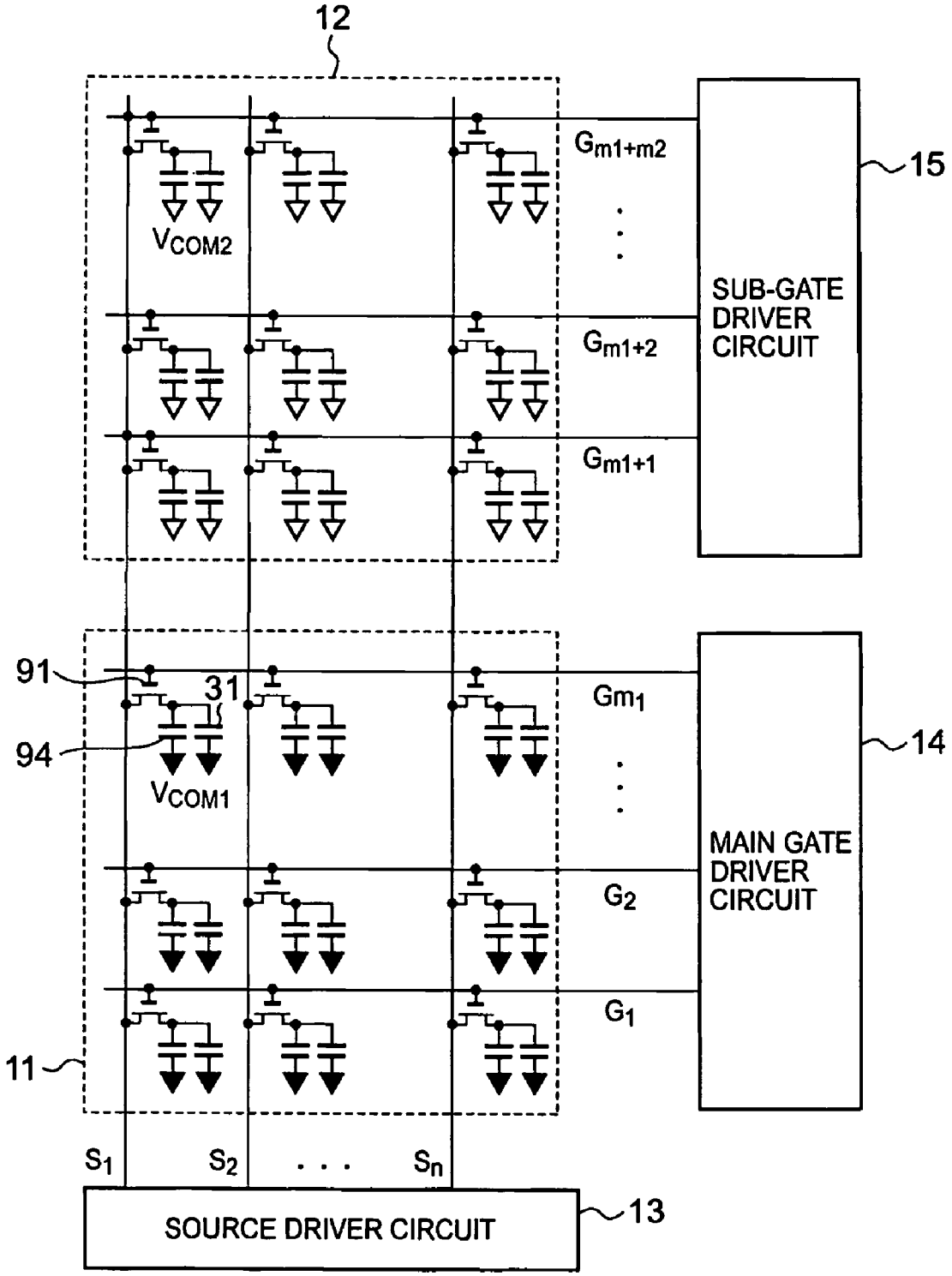
FIG. 3 is an equivalent circuit view of each LCD panel of the display apparatus related to the present invention.

FIG. 3 is a circuit composition view showing the equivalent circuit of each LCD panel of the display apparatus related to the present invention.

As shown in FIG. 2 and FIG. 3, the LCD 1 composition comprises a main LCD panel 11, a sub-LCD panel 12, a source driver circuit 13 (signal driver), a main gate driver circuit 14 (scan driver), a sub-gate driver circuit 15 (scan driver), a main VCOM generation circuit 16 (common electrode driver), a sub-VCOM generation circuit 17 (common electrode driver), a reverse RGB generation circuit 18, an LCD controller circuit 19, etc. Here, the source driver circuit 13, the main gate driver circuit 14, the sub-gate driver circuit 15, the main VCOM generation circuit 16 and the sub-VCOM generation circuit 17 are included in the driver circuit of FIG. 1.

Figure 9:
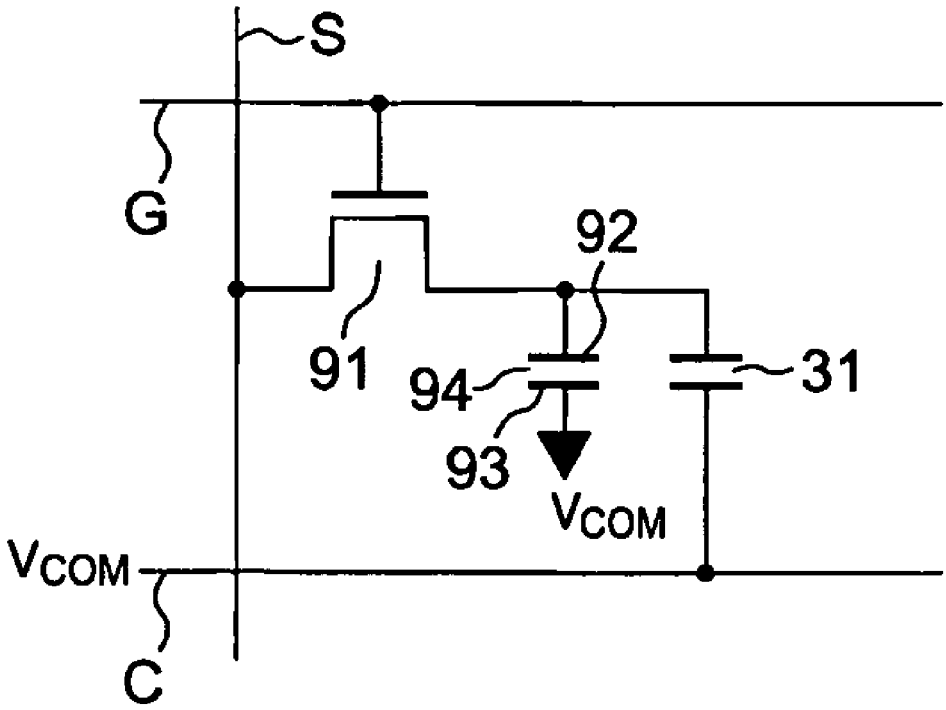
FIG. 9 PRIOR ART
FIG. 9 is an equivalent circuit view of a conventional prior art display pixel.
Figure 10:
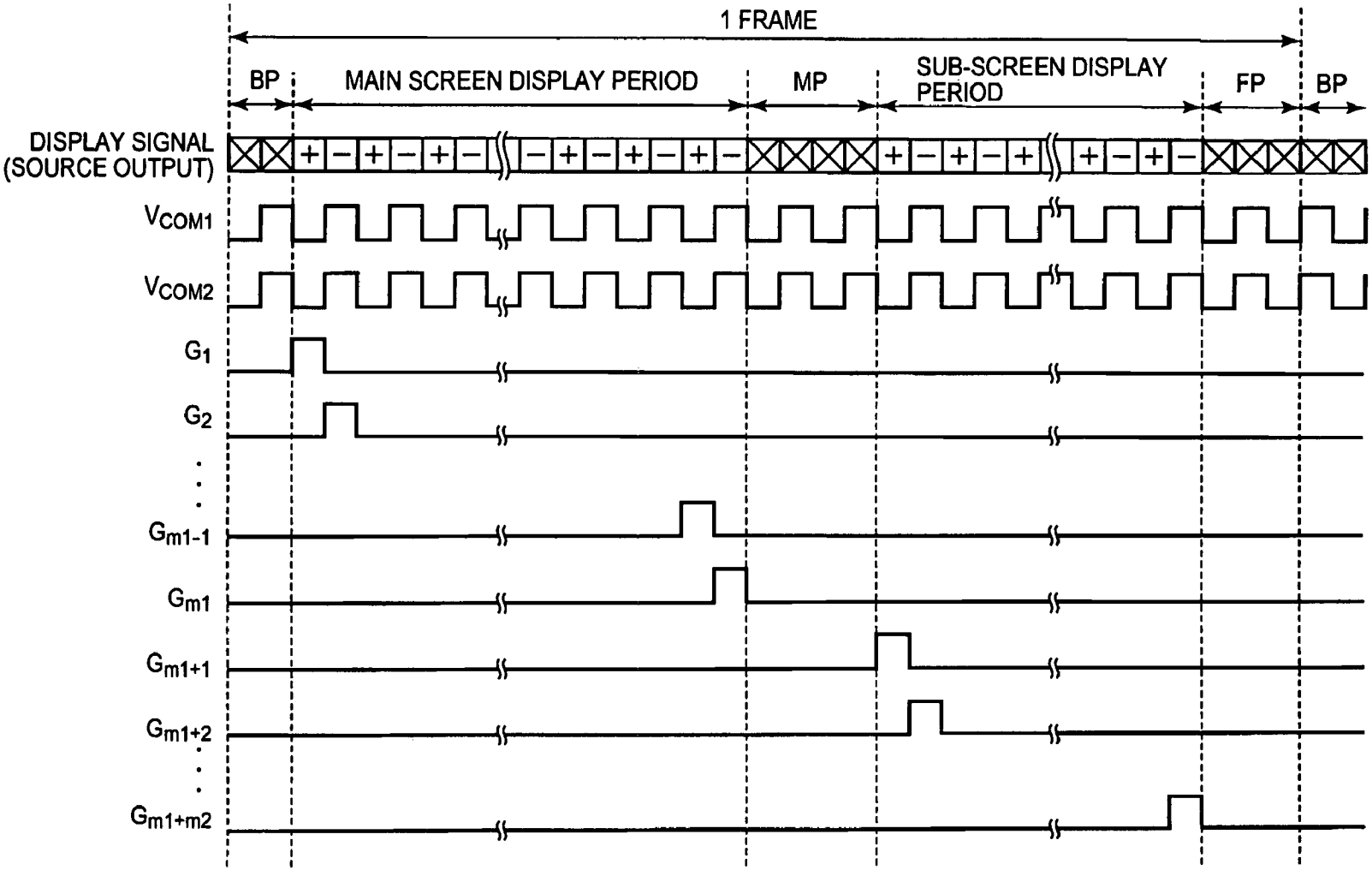
FIG. 10 PRIOR ART
FIG. 10 is a diagram showing a signal waveform of a conventional prior art LCD panel.
Figure 11:
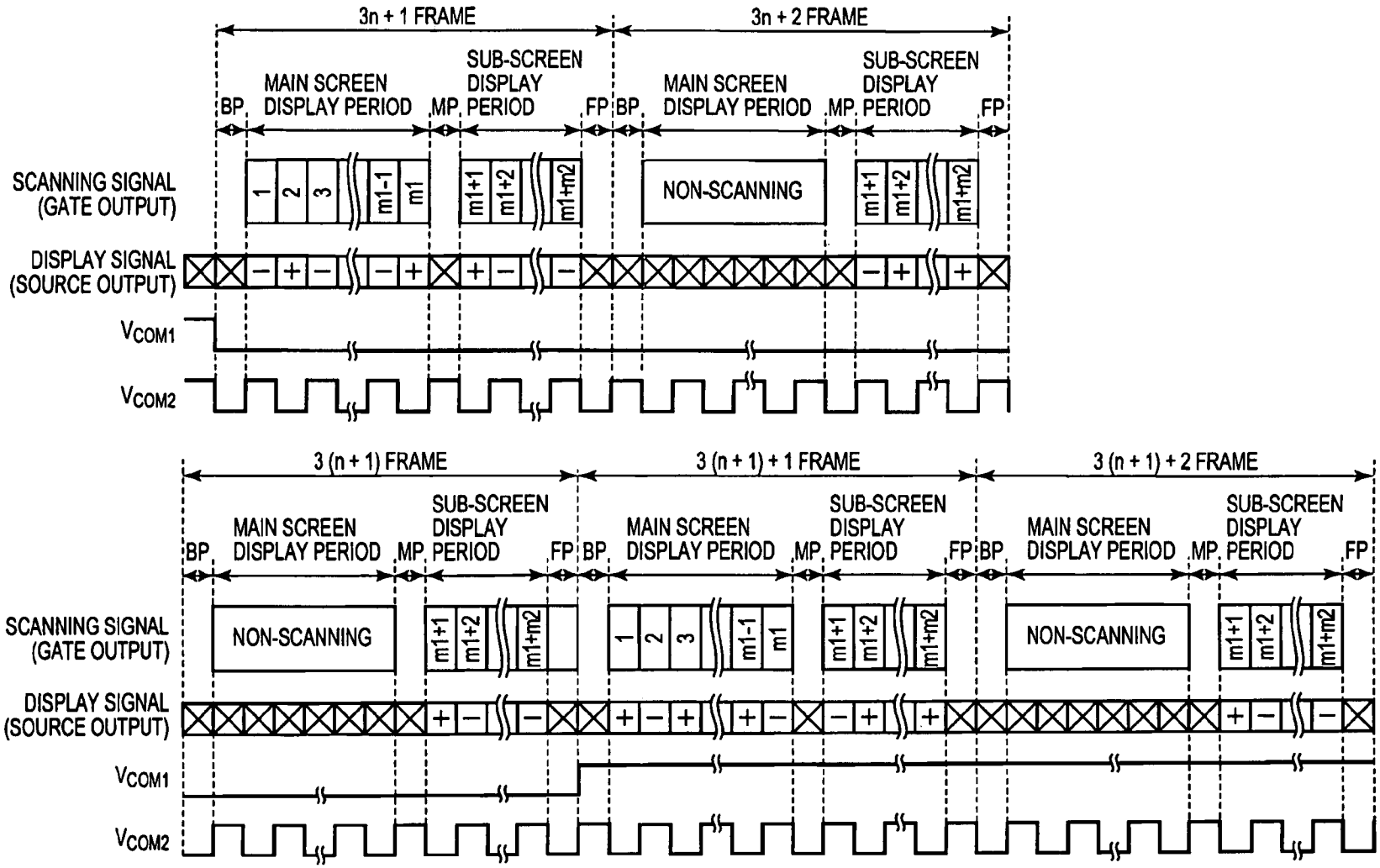
FIG. 11 PRIOR ART
FIG. 11 is a diagram showing a signal waveform which includes a refresh operation of a conventional prior art LCD panel.

Additionally, in the main LCD panel 11, the scanning lines $G_1$~$G_{m1}$ (gate lines) of m1 number are connected to the main gate driver circuit 14 and arranged (wired) in rows, whereas the signal lines $S_1$~$S_n$ (source lines) of n number are connected to the source driver circuit 13 and arranged in columns. Also, a plurality of display pixels are formed near each intersection point of the scanning lines $G_1$~$G_{m1}$ and the signal lines $S_1$~$S_n$. Each of the display pixels has the same structure as the composition shown in FIG. 9 and these display pixels are formed composed of the TFT 91 which is an active element, the pixel capacitance 94 (liquid crystal capacitance) which constitutes liquid crystal filled between the pixel electrode and common electrode (92, 93), along with the auxiliary capacitance 31 provided in parallel to the pixel capacitance 94 which holds the applied signal voltage of the pixel capacitance 94. Namely, a screen of the pixel number [n×m1] is formed in the main LCD panel 11.

In more detail, with regard to the pixel capacitance 94, the pixel electrode 92 is connected to the scanning lines G and the signal lines S via the TFT 91. The common voltage $V_{COM1}$ (common electrode signal) generated by the main VCOM generation circuit 16 is applied to the common lines C connected to the common electrode 93 and the other end of the auxiliary capacitance 31.

Also, when high electric potential is sequentially applied to the scanning lines $G_1$~$G_{m1}$ which sets a selective state, correspondingly the TFT 91 of each display pixel performs an "ON" operation. Display data of one line portions is written in by the electric potential of the signal lines $S_1$~$S_n$ which is applied corresponding to each of these display pixels and one image is displayed on the main LCD panel 11.

Further, the signal lines $S_1$~$S_n$ wired to the main LCD panel 11 are extended (stretched) to the sub-LCD panel 12 via a flexible printed circuit board (FPC).

In the sub-LCD panel 12, the scanning lines $G_{m1+1}$~$G_{m1+m2}$ of m2 number are connected to the sub-gate driver circuit 15 and arranged in rows, whereas the signal lines $S_1$~$S_n$ of n number are extended from the main LCD panel 11 and arranged in columns. Also, near each intersection point of the scanning lines $G_{m1+1}$~$G_{m1+m2}$ and the signal lines $S_1$~$S_n$, the display pixels are formed composed of the TFT 91, the pixel capacitance 94 and the auxiliary capacitance 31 like the main LCD panel. Namely, a screen of the pixel number [n×m2] is formed in the sub-LCD panel 12.

Besides, the common voltage $V_{COM2}$ (common electrode signal) generated by the sub-VCOM generation circuit 17 is applied to the common lines C connected to the common electrode 93 of the pixel capacitance 94 and the other end of the auxiliary capacitance 31. Also, when high electric potential is sequentially applied to the scanning lines $G_{m1+1}$~$G_{m1+m2}$.. which sets a selective state, correspondingly the TFT 91 of each display pixel performs an "ON" operation. Display data of one line portions is written in by the electric potential of the signal lines $S_1$~$S_n$ which is applied corresponding to each of these display pixels and one image is displayed on the sub-LCD panel 12.

Namely, in LCD 1 of this preferred embodiment, the signal lines $S_1$~$S_n$ connected to one source driver circuit 13 are wired in common to the main LCD panel 11 and the sub-LCD panel 12 and driven by the source driver circuit 13. The reverse RGB generation circuit 18 extracts a horizontal synchronization signal H, a vertical synchronization signal V and a composite synchronization signal CSY from the video signal (display signal) inputted from the exterior of the LCD 1 and outputs these signals to the LCD controller circuit 19. Also, each RGB chrominance signal (RGB signal) contained in the video signal is extracted. Based on a polarity reversal signal FRP inputted from the LCD controller circuit 19, the polarity of the RGB signal is cyclically reversed and a reversed RGB signal (luminance signal) is generated and outputted to the source driver circuit 13.

The LCD controller circuit 19 performs control for displaying the image based on the video signal to the main LCD panel 11 and the sub-LCD panel 12 according to the horizontal synchronization signal H, the vertical synchronization signal V and the composite synchronization signal CSY inputted from the reverse RGB generation circuit 18.

Specifically, the LCD controller circuit 19 generates the polarity reversal signal FRP which controls the polarity reversal of the display signal applied to the signal lines $S_1$~$S_n$ and outputs the reverse RGB generation circuit 18. Also, while generating a main polarity reversal signal FRP1 to control the polarity reversal of the common voltage $V_{COM1}$ applied to the common lines C of the main LCD panel 11 and outputting to the main VCOM generation circuit 16, a sub-polarity reversal signal FRP2 is generated to control the polarity reversal of the common voltage $V_{COM2}$ applied to the common lines C of the sub-LCD panel 12 and outputted to the sub-VCOM generation circuit 17.

Furthermore, the LCD controller circuit 19 generates a horizontal control signal to control the applied timing of the display signal to the signal lines $S_1$~$S_n$ and outputs to the source driver circuit 13. Also, while generating a main vertical control signal (main vertical synchronizing signal) to control the applied timing of the scanning signal (gate pulse) to the scanning lines $G_1$~$G_{m1}$ and outputting to the main gate driver circuit 14, a sub-vertical control signal (sub-vertical synchronizing signal) is generated to control the applied timing of the scanning signal (gate pulse) to the scanning lines $G_{m1+1}$~$G_{m1+m2}$ and outputted to the sub-gate driver circuit 15.

The source driver circuit 13 sequentially samples the reversed RGB signal (luminance signal) inputted from the reverse RGB generation circuit 18 based on the horizontal control signal inputted from the LCD controller circuit 19 and simultaneously applies the display signal voltage corresponding to the signal lines $S_1$~$S_n$ in each horizontal scanning period.

The main gate driver circuit 14 sequentially applies the scanning signal (gate pulse) to the scanning lines $G_1$~$G_{m1}$ of the main LCD panel 11 based on the main vertical control signal inputted from the LCD controller circuit 19. Also, the main gate driver circuit comprises a main shift register circuit 141. The main shift register circuit 141 inputs, for example, a main gate start signal, a main gate clock signal and a main gate enable signal as the main vertical control signals from the LCD controller circuit 19.

The main gate start signal is a signal representing the data for setting the selection/non-selection of the scanning lines corresponding to each shift register that forms the main shift register circuit 141, for example, composed of data represented by "1" (one) or "0" (zero). The main shift register circuit 141 synchronizes with the main gate clock signal along with the input of the main gate start signal and performs sequential shift operations. Also, when the main gate enable signal is inputted, this signal is applied to the scanning lines corresponding to the data set in each shift register. For example, when "1" is set in the shift register corresponding to the scanning line $G_1$, the voltage (high-level) corresponding to "1" is applied to the scanning line $G_1$ as the scanning signal (gate pulse) by the input of the main gate enable signal.

The sub-gate driver circuit 15 sequentially applies the scanning signal (gate pulse) to the scanning lines $G_{m1+1}$~$G_{m1+m2}$ of the sub-LCD panel 12 based on the sub-vertical control signal inputted from the LCD controller circuit 19. The sub-gate driver circuit 15 comprises a sub-shift register circuit 151. The sub-shift register circuit 151 inputs, for example, a sub-gate start signal, a sub-gate clock signal and a sub-gate enable signal as the sub-vertical control signals from the LCD controller circuit 19.

The sub-gate start signal is a signal representing the data for setting the selection/non-selection of the scanning lines corresponding to each shift register that forms the sub-shift register circuit 151, for example, composed of data represented by "1•• (one) or "0" (zero) . Also, when the sub-gate enable signal is inputted, this signal is applied to the scanning lines corresponding to the data set in each shift register. For example, when "1" is set in the shift register corresponding to the scanning line $G_{m1+1}$, the voltage (high-level) corresponding to "1" is applied to the scanning line $G_{m1+1}$ as the scanning signal (gate pulse) by the input of the sub-gate enable signal.

The main VCOM generation circuit 16 generates the common voltage $V_{COM1}$ which is reversed in polarity based on the main polarity reversal signal FRP1 inputted from the LCD controller circuit 19 and applies this voltage to the common line C1 of the main LCD panel 11. Additionally, the sub-VCOM generation circuit 17 generates the common voltage $V_{COM2}$ which is reversed in polarity based on the sub-polarity reversal signal FRP2 inputted from the LCD controller circuit 19 and applies this voltage to the common line C2 of the sub-LCD panel 12.

In the above-mentioned configuration, with the various types of control signals outputted from the LCD controller circuit 19, such as the main vertical control signals (main gate start signal, main gate clock signal, main gate enable signal, etc.) inputted to the main gate driver circuit 14, the sub-vertical control signals (sub-gate start signal, sub-gate clock signal, sub-gate enable signal) inputted to the sub-gate driver circuit 15, the horizontal control signal inputted to the source driver circuit 13, the main polarity reversal signal FRP1, the sub-polarity reversal signal FRP2, etc., the scanning operation for each scanning line of the main LCD panel 11 and the sub-LCD panel 12, as well as the output timing of the display signal applied to the scanning lines and polarity reversal drive of that display signal along with polarity reversal drive of the common voltage $V_{COM1}$ and $V_{COM2}$ are controlled.

Hereinafter, the preferred embodiments explained below control the LCD controller circuit 19 and drive the main LCD panel 11 and the sub-LCD panel 12.

First Preferred Embodiment

Next, the first preferred embodiment of the display apparatus related to the present invention will be explained with reference to the example diagram.

Figure 4:
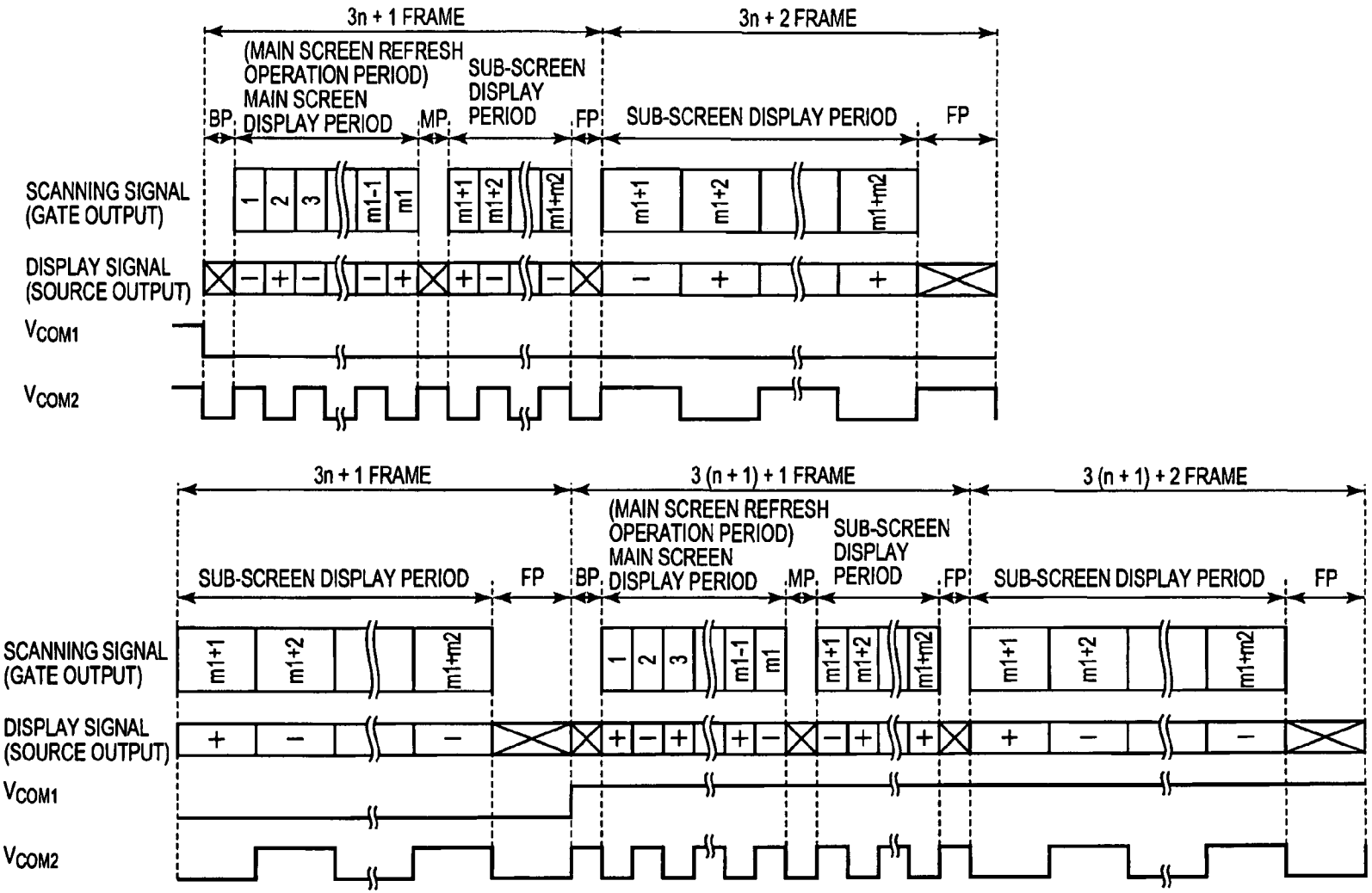
FIG. 4 is a diagram showing a signal waveform of each LCD panel for explaining the drive control method of the first preferred embodiment of the display apparatus related to the present invention.

FIG. 4 is a diagram showing a signal waveform of each LCD panel for explaining the drive control method of the first preferred embodiment of the display apparatus related to the present invention.

The first preferred embodiment is characterized by the following particulars. Namely, the time duration of the frame periods is maintained constant. When set in the non-display state, a refresh operation of the LCD panel is not performed in the frame periods. When set in the non-display state, the period corresponding to the scanning periods of the LCD panel is not provided. When set in the display state, the frequency (number of times) of line reversals of the LCD panel is decreased. When set in the display state, the frequency of polarity reversals in 1 frame period of the common electrode signal applied to the common electrode of the LCD panel is decreased.

FIG. 4 is an example case of setting the main LCD panel 11 in the non-display state and setting the sub-LCD panel 12 in the display state. Also, a refresh operation of the main LCD panel 11 is performed at the rate of one time every three frames. As seen in FIG. 4, the time axis is set on the horizontal axis. The sequence listed from the top shows a signal waveform of the gate numbers to which the scanning signal is applied, the polarity of the display signal applied to the signal lines S, the common voltage $V_{COM1}$ (common electrode signal) applied to the common electrode of the main LCD panel 11 and the common voltage $V_{COM2}$ (common electrode signal) applied to the common electrode of the sub-LCD panel 12.

Here, a refresh operation of the main LCD panel 11 is performed at the 3n+1 frame and the 3(n+1)+1 frame. For example, at the 3n+1 frame in which a refresh operation of the main LCD panel 11 is performed in the main screen display period (main screen refresh operation period), the scanning signal is sequentially applied to each scanning line and the scanning lines $G_1$~$G_{m1}$ of the main LCD panel 11 are sequentially scanned. Besides, the signal voltage for setting the main LCD panel 11 as a full screen white display is applied to the signal lines S. Then, in the sub-screen display period, the scanning lines $G_{m1+1}$~$G_{m1+m2}$ of the sub-LCD panel are sequentially scanned and the display signal of the image to be displayed on the sub-LCD panel 12 is applied to the signal lines S.

Subsequently, in the 3n+2 frame and 3(n+1) frame, because this is a period when a refresh operation is not performed, the period corresponding to the main screen display period does not exist. Instead, a 1 frame period of only the sub-screen display period and FP are performed. However, in order to maintain the time duration of 1 frame period constant, gate scanning and the frequency of line reversals of the sub-LCD panel 12 are decreased and a display operation is performed. Accordingly, when the main LCD panel 11 is set in the non-scan state, in the sub-screen display period, the cycle of line scans is lengthened and the scanning lines $G_{m1+1}$~$G_{m1+m2}$ of the sub-LCD panel 12 are sequentially scanned. Besides, the display signal of the image to be displayed on the sub-LCD panel 12 is applied to the signal lines S.

Next, in the 3(n+1)+1 frame, the polarity of the common voltage $V_{COM1}$ applied to the main LCD panel 11 is reversed and a refresh operation of the main LCD panel 11 is performed again.

In this manner, for example, when the main LCD panel 11 is set in the non-display state and the sub-LCD panel 12 is set in the display state, in the frame periods which do not perform a refresh operation of the main LCD panel 11, gate scanning and the frequency of line reversal drive of the sub-LCD panel 12 can be decreased by eliminating the main screen display period and only performing the sub-screen display period. Accordingly, the frequency of polarity reversals for the common voltage $V_{COM2}$ corresponding to the sub-LCD panel 12 in the frame periods which set the main LCD panel 11 in the non-display state and in contrast to the frequency of polarity reversals for the common voltage $V_{COM2}$ (common electrode signal) in the frame periods which perform a refresh operation of the main LCD panel 11 can be decreased. Thereby, the power consumption of the LCD 1 can be reduced.

Second Preferred Embodiment

Next, the second preferred embodiment of the display apparatus related to the present invention will be explained with reference to the example diagram.

Figure 5:
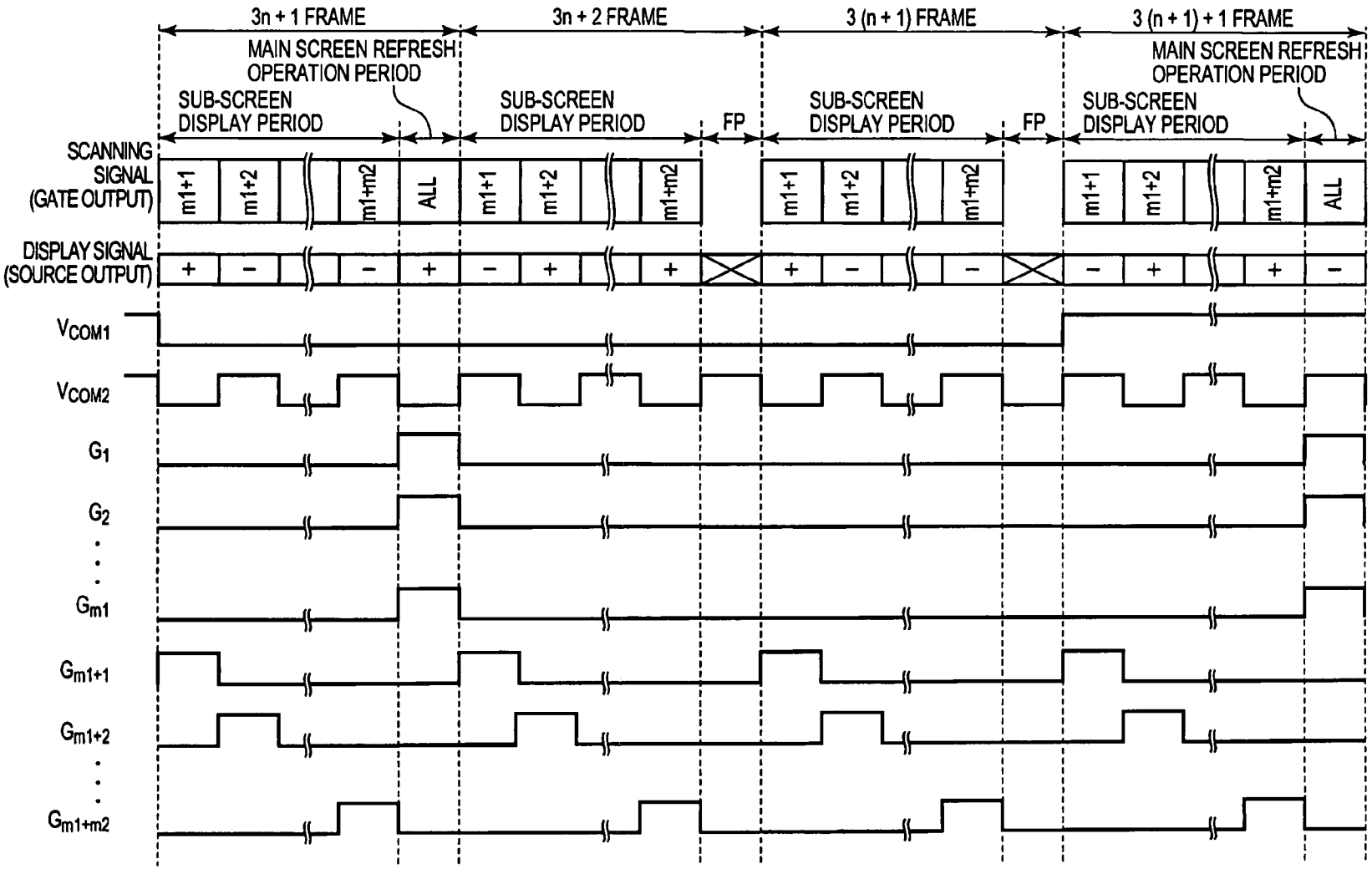
FIG. 5 is a diagram showing a signal waveform of each LCD panel for explaining the drive control method of the second preferred embodiment of the display apparatus related to the present invention.

FIG. 5 is a diagram showing a signal waveform of each LCD panel for explaining the drive control method of the second preferred embodiment of the display apparatus related to the present invention.

The second preferred embodiment is characterized by the following particulars. Namely, when set in the display state, the frequency of polarity reversals in 1 frame period of the common electrode signal applied to the common electrode of the LCD panel is further decreased in contrast to the case of the first preferred embodiment by performing a refresh operation of the LCD panel which has been set in the non-display state•• to all of the scanning lines as a batch (collectively).

FIG. 5 is an example case of setting the main LCD panel 11 in the non-display state and setting the sub-LCD panel 12 in the display state, as well as a refresh operation of the main screen LCD panel is performed as a full screen batch (collectively) at the rate of one time every three frames. As seen in FIG. 5, the time axis is set on the horizontal axis. The sequence listed from the top shows a signal waveform of the gate numbers to which the scanning signal is applied, the polarity of the display signal applied to the signal lines S, the common voltage $V_{COM1}$ (common electrode signal) applied to the common electrode of the main LCD panel 11, the common voltage $V_{COM2}$ (common electrode signal) applied to the common electrode of the sub-LCD panel 12 and each of the scanning lines G of the main LCD panel 11 and the sub-LCD panel 12.

For example, a refresh operation is performed at the 3n+1 frame and constituted by a sub-screen display period, a main screen refresh operation period and FP. In the sub-screen display period, the scanning lines $G_{m1+1}$~$G_{m1+m2}$ of the sub-LCD panel are sequentially scanned and the display signal of the image to be displayed on the sub-LCD panel 12 is applied to the signal lines S.

Here, the main screen refresh operation period, for example, is set in a one line scanning period. In this main screen refresh operation period, each scanning line of the main LCD panel 11 is sequentially scanned and each display pixel is not sequentially refreshed, but all the scanning lines are collectively set in a selective state. A refresh operation is performed by applying the display signal representing a white display to all of the signal lines from the source driver circuit 13. Furthermore, in the main screen refresh operation period, it is required to set all of the scanning lines in a selective state simultaneously. This, for example, applies the signal of "1, 1, 1, 1, 1••• • •" to the main shift register circuit 141 as the main gate start signal from the LCD controller circuit 19 and sets "1" in all the registers. Synchronizing with the output of the main gate enable signal, a main screen refresh operation can be performed by applying the scanning signal (gate pulse) to all of the scanning lines from all the registers of the main shift register circuit 141.

Subsequently, in the 3n+2 frame and the 3(n+1) frame, because a refresh operation of the main LCD panel 11 is not performed, the main screen display period does not exist. For example, a 1 frame period becomes only a sub-screen display period and FP. The period length (1 line scanning period) corresponding to the main screen refresh operation period becomes FP. In the sub-screen display period, the scanning lines $G_{m1+1}$~$G_{m1+m2}$ of the sub-LCD panel are sequentially scanned and the display signal of the image to be displayed on the sub-LCD panel is applied to the signal lines S. Here, in the cases of the main screen refresh operation period in the frame periods when a refresh operation is performed and FP in the frame periods when a refresh operation is not performed are set for the same value (one line scanning period). In either of these constant frame periods, gate scanning, the frequency of line reversals of the sub-LCD panel 12 and the frequency of polarity reversals for the common voltage $V_{COM2}$ are similarly set.

Next, in the 3(n+1)+1 frame, the polarity of the common voltage $V_{COM1}$ applied to the main LCD panel 11 is reversed and a refresh operation of the main LCD panel 11 is performed again.

In this manner, for example, when the main LCD panel 11 is set in the non-display state and the sub-LCD panel 12 is set in the display state, in the frame periods which do not perform a refresh operation of the main LCD panel 11, gate scanning and the frequency of line reversals for the sub-LCD panel 12 are decreased by eliminating the main screen display period like the first preferred embodiment and only performing the sub-screen display period. Also, the frequency of polarity reversals for the common voltage $V_{COM2}$ (common electrode signal) corresponding to the sub-LCD panel 12 can be decreased.

Furthermore, as for the preferred embodiment, in the frame periods which perform a refresh operation of the main LCD panel 11, by performing the main screen refresh operation period in a one line scanning period which collectively drives a full screen as compared with the case of sequentially applying the scanning signal to each scanning line and performing a refresh operation of the main LCD panel 11 like the first preferred embodiment, gate scanning and the frequency of line reversal drive for the sub-LCD panel 12 can be decreased.

Accordingly, also the frame periods in which a refresh operation of the main LCD panel 11 is performed, because the frequency of polarity reversals for the common voltage $V_{COM2}$ corresponding to the sub-LCD panel 12 can be decreased, power consumption can be further decreased.

Moreover, in the above-mentioned, the periods which perform a refresh operation are carried out in a one line scanning period. If the load carrying capacity related to all the scanning lines is taken into consideration, when collectively performing drive of a full screen in a short time, the burden may become high and the refresh operation may not be completed in a one line scanning period. Therefore, the periods which perform a refresh operation may be increased to plural line scanning periods and FP may be increased to plural line scanning periods corresponding to this refresh operation period.

Third Preferred Embodiment

Next, the third preferred embodiment of the display apparatus related to the present invention will be explained with reference to the example diagram.

Figure 6:
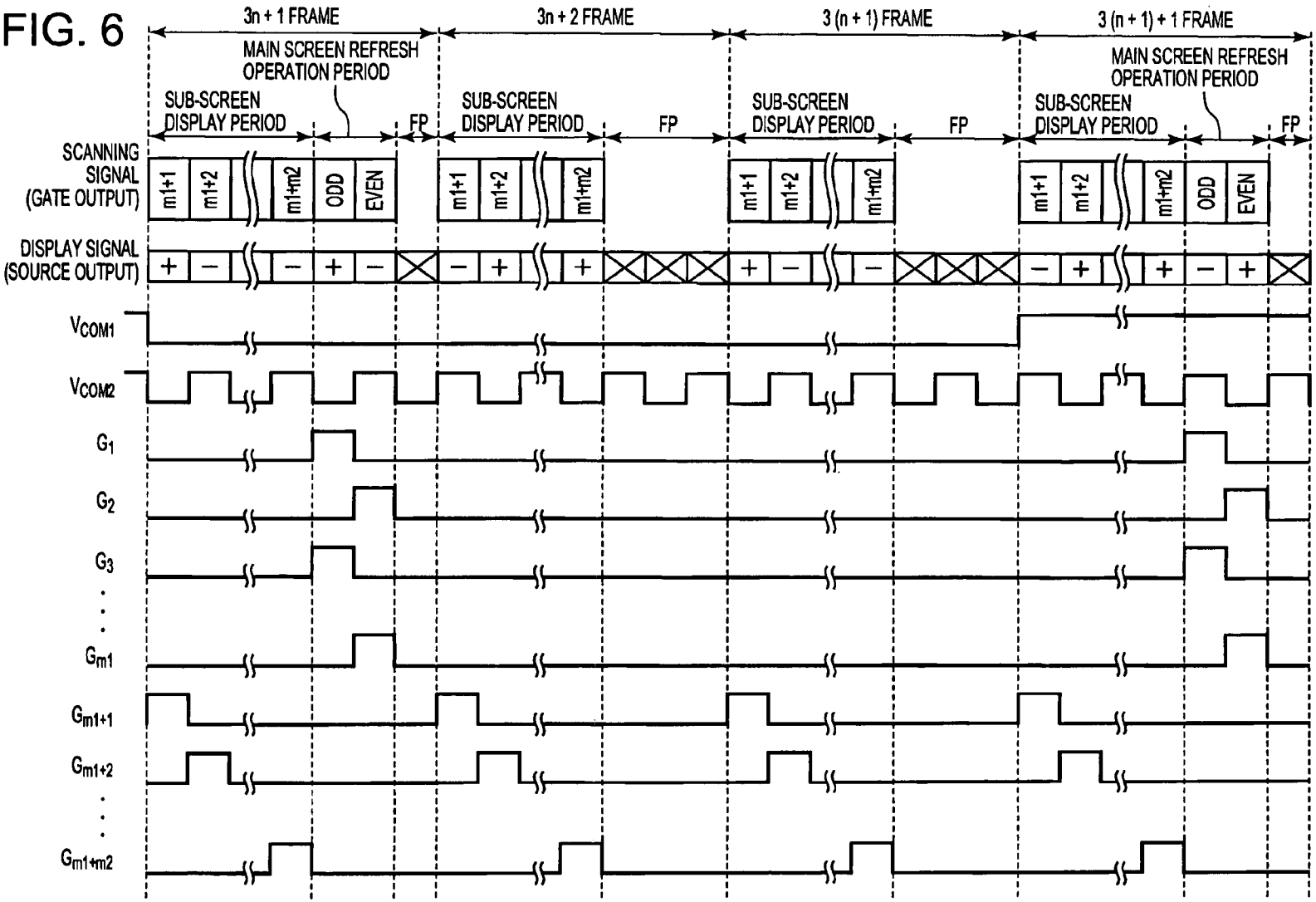
FIG. 6 is a diagram showing a signal waveform of each LCD panel for explaining the drive control method of the third preferred embodiment of the display apparatus related to the present invention.

FIG. 6 is a diagram showing a signal waveform of each LCD panel for explaining the drive control method of the third preferred embodiment of the display apparatus related to the present invention.

The third embodiment when contrasted with the second preferred embodiment is characterized by a refresh operation of the LCD panel set in the non-display state in which all the scanning lines of that LCD panel are divided into each of a plurality of scanning lines and performed for each of the plurality of divided scanning lines.

FIG. 6 is an example case of setting the main LCD panel 11 in the non-display state and setting the sub-LCD panel 12 in the display state, as well as all of the scanning lines of the main LCD panel 11 are divided in half and refreshed at the rate of one time every three frames. As seen in FIG. 6, the time axis is set on the horizontal axis. The sequence listed from the top shows a signal waveform of the gate numbers to which the scanning signal is applied, the polarity of the display signal applied to the signal lines S, the common voltage $V_{COM1}$ (common electrode signal) applied to the common electrode of the main LCD panel 11, the common voltage $V_{COM2}$ (common electrode signal) applied to the common electrode of the sub-LCD panel 12 and each of the scanning lines G of the main LCD panel 11 and the sub-LCD panel 12.

For example, a refresh operation is performed at the 3n+1 frame and constituted by a sub-screen display period, a main screen refresh operation period and FP. Here, FP is set as a one line scanning period. In the sub-screen display period, the scanning lines $G_{m+1}$~$G_{m1+m2}$ are sequentially scanned and the display signal of the image to be displayed on the sub-LCD panel 12 is applied to the signal lines S.

The main screen refresh operation period is a two line scanning period. Each of the scanning lines of the main LCD panel 11, for example, is divided in half containing odd numbered scanning lines and even numbered scanning lines. The odd numbered scanning lines are collectively placed (batched) in the first half of the main screen refresh operation period and set in a selective state. A refresh operation is performed by applying the display signal representing a white display to all of the signal lines from the source driver circuit 13. Also, the even numbered scanning lines are collectively placed (batched) in the second half of the main screen refresh operation period and set in a selective state. A refresh operation is performed by applying the display signal representing a white display to all of the signal lines from the source driver 13. Accordingly, a full screen is refreshed for the main LCD panel 11 in two steps of half-and-half.

Subsequently, in the 3n+2 frame and the 3(n+1) frame, because a refresh operation of the main LCD panel 11 is not performed, the main screen refresh operation does not exist and becomes only a sub-screen display period and FP. Here, FP is set as a three line scanning period. In the sub-screen display period, the scanning lines $G_{m1+1}$~$G_{m1+m2}$ of the sub-LCD panel are sequentially scanned and the display signal of the image to be displayed on the sub-LCD panel is applied to the signal lines S.

Next, in the 3(n+1)+1 frame, the polarity of the common voltage $V_{COM1}$ applied to the main LCD panel 11 is reversed and a refresh operation of the main LCD panel 11 is performed again.

Here, in the cases of the main screen refresh operation period in frame periods when a refresh operation is performed and the period is combined with FP, as well as FP in the frame periods when a refresh operation is not performed are set as the same value (three line scanning period). In either of these frame periods, gate scanning and the frequency of line reversals of the sub-LCD panel 12 and the frequency of polarity reversals of the common voltage $V_{COM2}$ are similarly set.

In addition, although the scanning lines of the LCD panel set in the non-display state described above are divided in halves of even numbered scanning lines and odd numbered scanning lines and explained as that which refreshes at respectively different timing, this embodiment is not limited to this. If the load carrying capacity related to the scanning lines is taken into consideration, a larger number of segments more than two, for example, three or four, is not a problem. Besides, in this case, the refresh operation period will be increased to the number of line scanning periods corresponding to the number of segments. For example, when dividing all the scanning lines into thirds and performing a refresh operation, a three line scanning period as a refresh operation period is required.

Next, an example of a concrete method for actualizing the drive control method of the preferred embodiment will be explained.

Figure 7:
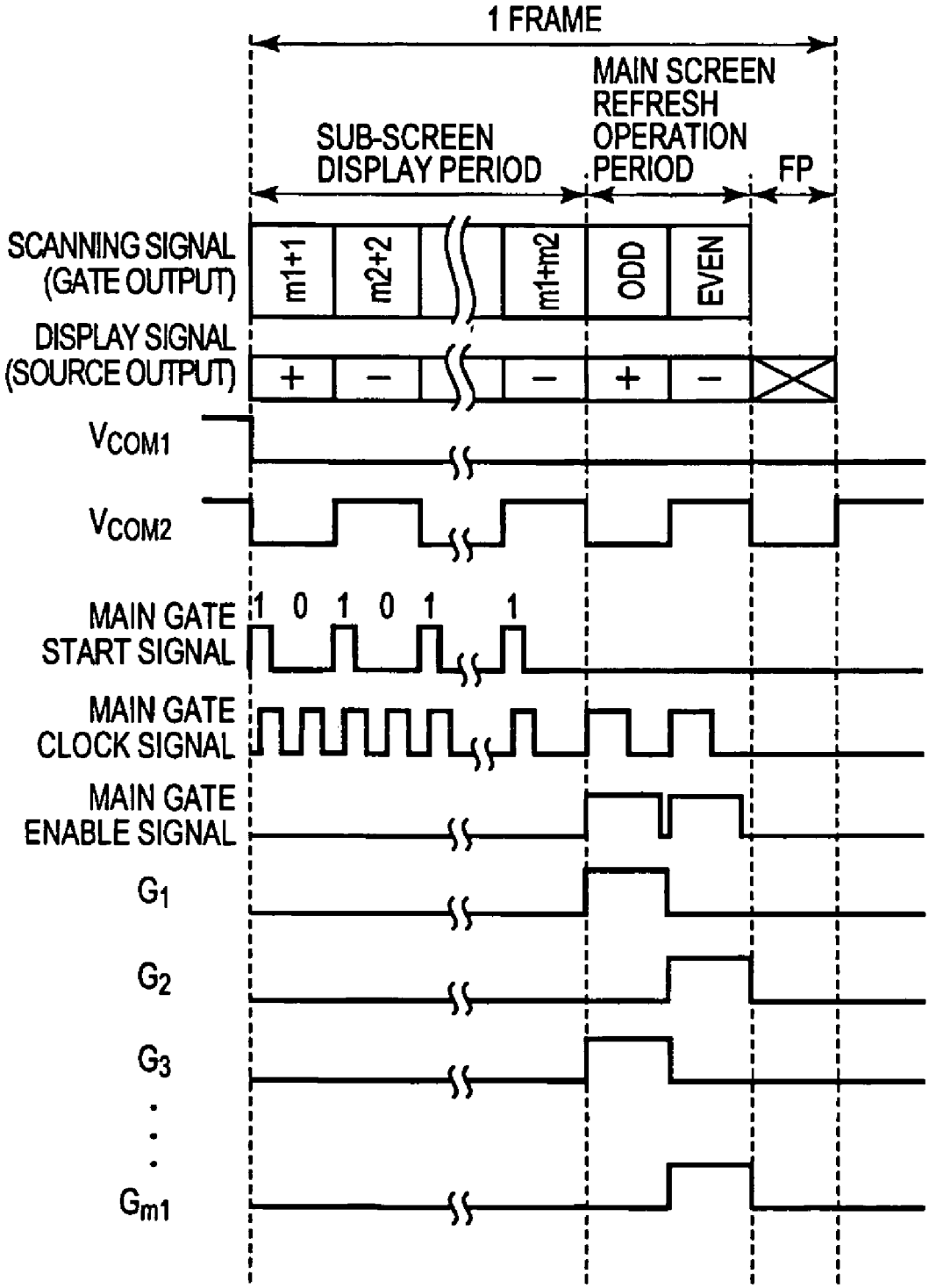
FIG. 7 is a diagram showing an example of a concrete signal waveform for actualizing the drive control method of the display apparatus in the third preferred embodiment.

FIG. 7 is a diagram showing an example of a concrete signal waveform for actualizing the drive control method of the display apparatus in the third preferred embodiment.

As seen in FIG. 7, the main LCD panel 11 is set in the non-display state and the sub-LCD panel is set in the display state, as well as an example of a frame in which all of the scanning lines of the main LCD panel 11 are divided in half and refreshes. As seen in FIG. 7, the time axis is set on the horizontal axis. The sequence listed from the top shows a signal waveform of the gate numbers to which the scanning signal is applied, the polarity of the display signal applied to the signal lines S, the common voltage $V_{COM1}$ applied to the common electrode of the main LCD panel 11, the common voltage $V_{COM2}$ applied to the common electrode of the sub-LCD panel 12, the main gate start signal, the main gate clock signal, the main gate enable signal and each of the scanning lines G of the main LCD panel 11.

In order to actualize the drive control method in the preferred embodiment, before a main screen refresh operation period, data needs to be inputted in each register which constitutes the main shift register circuit 141 and sets selection/non-selection of the scanning lines corresponding to each register. Then, for example, when dividing the scanning lines of the main LCD panel 11 in half containing odd numbered scanning lines and even numbered scanning lines and performing a refresh operation, the signal of "1, 0, 1, 0, 1••• •" is applied to the mains shift register 141 as the main gate start signal from the LCD controller circuit 19. Here, data composed of "1" represents line selection and "0" represents line non-selection. Furthermore, in the case of dividing all the scanning lines into thirds, the main gate start signal is composed of "1, 0, 0, 1, 0, 0, 1 •••" and in the case of dividing into fourths, the main gate start signal is composed of "1, 0, 0, 0, 1, 0, 0, 0, 1 •••." Then, synchronizing with the main gate clock signal, the main gate start signal is inputted to the main shift register 141 and sequential shift operations are performed. These operations are continued until data is stored in all the registers, which ultimately becomes the state where "1" is set in the registers corresponding to odd numbered scanning lines and "0" is set in the registers corresponding to even numbered scanning lines.

Subsequently, synchronizing with the output of the main gate enable signal, the scanning lines corresponding to the registers set as "1" in each register of the main shift register circuit 141 will become a selective state. Namely, a signal is applied to the odd numbered scanning lines of the scanning lines $G_1$, etc. and a refresh operation is performed.

Also, simultaneously with the output of the main gate enable signal, the main gate clock signal is outputted. Synchronizing to this clock output, a shift operation of the main shift register circuit 141 is performed. According to this shift operation, the state shifts to where "0" is set in the registers corresponding to odd numbered scanning lines and "1" is set in the registers corresponding to even numbered scanning lines. Then, corresponding to the output of the second main enable signal, the scanning lines corresponding to the registers set as "1" in each register circuit of the main shift register circuit 141 will become a selective state. Namely, a signal is applied to the even numbered scanning lines of the scanning lines $G_2$, etc. and a refresh operation is performed.

Furthermore, the operation which inputs the main gate start signal relative to the main shift register circuit 141 before a main screen refresh operation period is always effective as well as frames, etc. which perform neither a sub-screen display period nor a refresh operation are also applicable.

Thus, in the preferred embodiment like the cases of the first and second preferred embodiments, for example, when the main LCD panel 11 is set in the non-display state and the sub-LCD panel 12 is set in the display state, in frame periods in which do not perform a refresh operation of the main LCD panel 11, while decreasing gate scanning and the frequency of line reversals of the sub-LCD panel 12 as only the sub-screen display period is performed, the frequency of polarity reversals for the common voltage $V_{COM2}$ corresponding to the sub-LCD panel 12 is decreased. In frame periods in which do perform a refresh operation of the main LCD panel 11, gate scanning and the frequency of line reversal drive of the sub-LCD panel 12 is decreased by dividing all of the scanning lines into each of a plurality of scanning lines for the main screen refresh operation and performing a refresh operation for each of the plurality of scanning lines. Since the frequency of polarity reversals for the common voltage $V_{COM2}$ corresponding to the sub-LCD panel 12 can be decreased, power consumption can be decreased.

Next, a modified example of the preferred embodiment will be explained.

Figure 8:
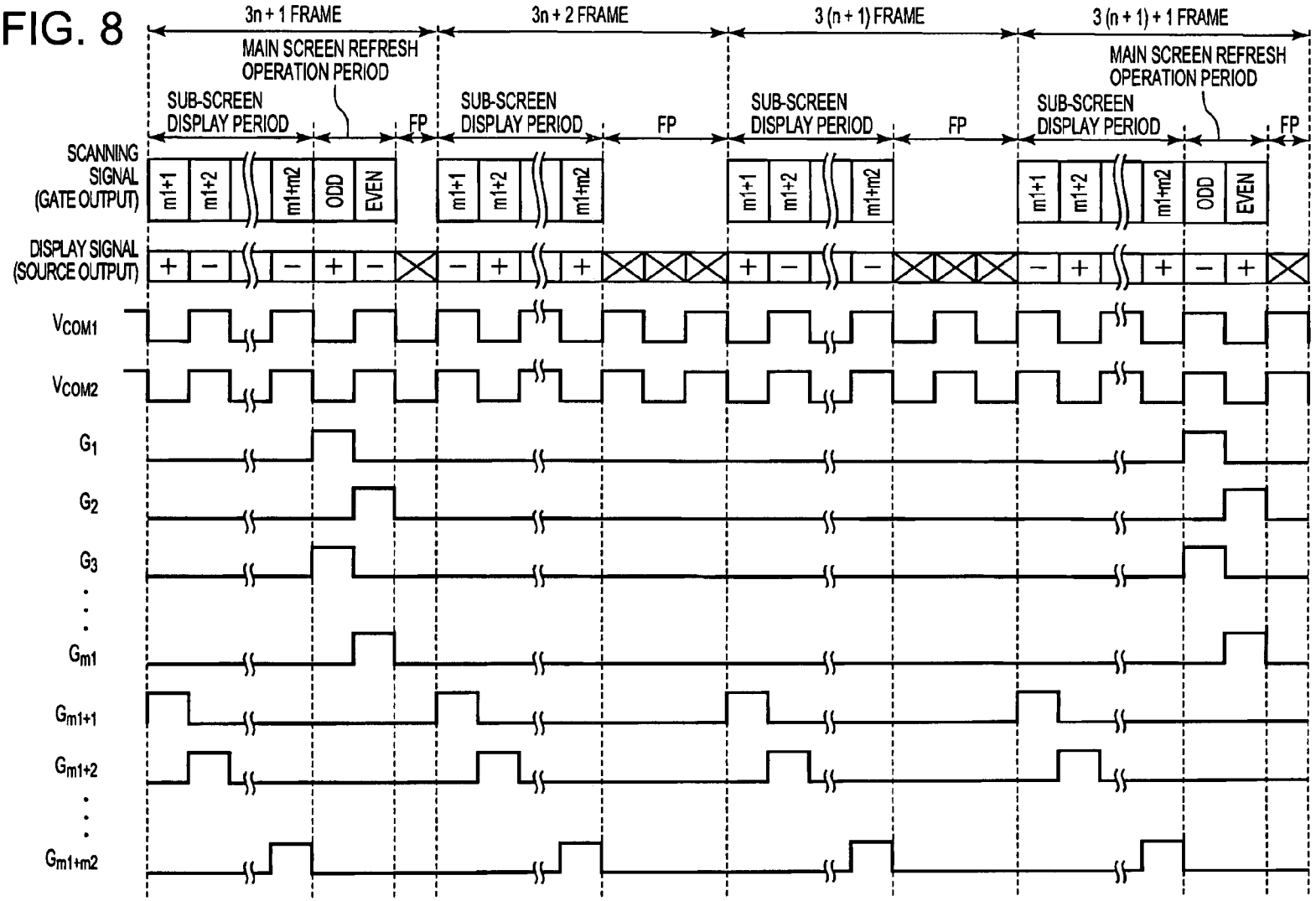
FIG. 8 is a diagram showing a signal waveform of each LCD panel for explaining the drive control method of the display apparatus in the third preferred embodiment.

FIG. 8 is a diagram showing a signal waveform of each LCD panel for explaining a modified example of the drive control method of the display apparatus in the preferred embodiment.

Namely, the main LCD panel 11 is set in the non-display state and the sub-LCD panel 12 is set in the display state, as well as all of the scanning lines of the main LCD panel are divided in half and refreshes at the rate of one time every three frames. As seen in FIG. 8, the time axis is set on the horizontal axis. The sequence listed from the top shows a signal waveform of the gate numbers to which the scanning signal is applied, the polarity of the display signal applied to the signal lines S, the common voltage $V_{COM1}$ applied to the common electrode of the main LCD panel 11, the common voltage $V_{COM2}$ applied to the common electrode of the sub-LCD panel 12 and each of the scanning lines G of the main LCD panel 11 and the sub-LCD panel 12.

In the preferred embodiment of the drive control method explained using FIG. 6, although the common voltage $V_{COM1}$ is applied to the main LCD panel 11 common electrode when set in the non-display state and in which a refresh operation is performed with polarity reversals in each of a plurality of frames (three frames), the preferred embodiment is not restricted to this. Namely, as shown in FIG. 8, it is possible to perform polarity reversals of the common voltage $V_{COM1}$ applied to the common electrode of the main LCD panel 11 set in the non-display state in the same cycle as the common voltage $V_{COM2}$ applied to the common electrode of the sub-LCD panel 12. Accordingly, the common voltage (common electrode signal) applied to each common electrode of the main LCD panel 11 and the sub-LCD panel 12 can be accomplish in phase. Thus, it becomes practicable to share one VCOM generation circuit with two LCD panels and the circuit area can be reduced.

While the present invention has been described with reference to the preferred embodiments, it is intended that the invention be not limited by any of the details of the description therein but includes all the embodiments which fall within the scope of the appended claims.

What is claimed is:

1. A display apparatus wherein signal lines of a first active-matrix type display panel are electrically connected to signal lines of a second active-matrix type display panel, the apparatus comprising:

a control section which, when controlling the first active-matrix type display panel to be put into a display state and the second active-matrix type display panel to be put into a non-display state, performs refresh operations of the second active-matrix type display panel every predetermined number of frames and controls a frequency of voltage switching at a common electrode of the first active-matrix type display panel in a period corresponding to the predetermined number of frames to become less than a frequency of voltage switching when putting both of the first active-matrix type display panel and the second active-matrix type display panel into display states.

2. The display apparatus according to claim 1, wherein the control section controls a first frame, in which a refresh period to perform a refresh operation of the second active-matrix type display panel within a frame period thereof is provided, to be inserted in a plurality of second frames in which the refresh period is not provided within a frame period thereof.

3. The display apparatus according to claim 2, wherein the control section controls the second active-matrix type display panel so as to perform scanning of scan lines during a period corresponding to the first frame and stop scanning of scan lines during a period corresponding to the second frames.

4. The display apparatus according to claim 2, wherein the control section carries out a refresh operation of the second active-matrix type display panel by performing scanning of scan lines during a period corresponding to the first frame to the second-active-matrix type display panel.

5. The display apparatus according to claim 2, wherein the control section controls each selection time in each scan line of the first active-matrix type display panel so that a selection time in the second frame becomes longer than a selection time in the first frame.

6. The display apparatus according to claim 5, wherein the control section performs control so that a voltage switching timing at the common electrode of the first active-matrix type display panel synchronizes with scanning of scan lines of the first active-matrix type display panel.

7. The display apparatus according to claim 3, wherein the control section controls the second active-matrix type display panel so that during periods corresponding to the first frame, the selection period of each scan line becomes equal.

8. The display apparatus according to claim 7, wherein the control section performs control so that between first frames that are adjacent in time a polarity of the common electrode in the second active-matrix type display panel differs.

9. The display apparatus according to claim 3, wherein the control section controls the second active-matrix type display panel so that during periods corresponding to the first frame a selection period of any one of scan lines becomes equal to a selection period of another scan line.

10. The display apparatus according to claim 3, wherein the control section controls the second active-matrix type display panel so that during a period corresponding to the first frame each selection period of odd number scan lines becomes equal and does not overlap with a selection period of even number scan lines.

11. The display apparatus according to claim 1, wherein the control section performs control so that a voltage switching timing at the common electrode of the second active-matrix type display panel synchronizes with scanning of scan lines of the second active-matrix type display panel.

12. An electronic device having a display apparatus wherein signal lines of a first active-matrix type display panel are electrically connected to signal lines of a second active-matrix type display panel, the electronic device comprising:

a control section which, when controlling the first active-matrix type display panel to be put into a display state and the second active-matrix type display panel to be put into a non-display state, performs refresh operations of the second active-matrix type display panel every predetermined number of frames and controls a frequency of voltage switching at a common electrode of the first active-matrix type display panel in a period corresponding to the predetermined number of frames to become less than a frequency of voltage switching when putting both of the first active-matrix type display panel and the second active-matrix type display panel into display states.

13. The electronic device according to claim 12, wherein the electronic device is a cellular phone comprising as a main screen one of the first active-matrix type display panel and the second active-matrix type display panel, and as a sub-screen the other of the first active-matrix type display panel and the second active-matrix display panel.

14. A drive method for a display apparatus, wherein signal lines of a first active-matrix type display panel are electrically connected to signal lines of a second active-matrix type display panel, the drive method comprising:

when controlling the first active-matrix type display panel to be put into a display state and the second active-matrix type display panel to be put into a non-display state, performing refresh operations of the second active-matrix type display panel every predetermined number of frames and controlling a frequency of voltage switching at a common electrode of the first active-matrix type display panel in a period corresponding to the predetermined number of frames to become less than a frequency of voltage switching when putting both of the first active-matrix type display panel and the second active-matrix type display panel into display states.

15. The drive method according to claim 14, wherein further comprising:

controlling a first frame, in which a refresh period to perform a refresh operation of the second active-matrix type display panel within a frame period thereof is provided, to be inserted in a plurality of second frames in which the refresh period is not provided within a frame period thereof.

* * * * *